United States Patent [19]

Pancheri

[11] 4,316,824

[45] Feb. 23, 1982

[54] LIQUID DETERGENT COMPOSITION CONTAINING ALKYL SULFATE AND ALKYL ETHOXYLATED SULFATE

[75] Inventor: Eugene J. Pancheri, Cincinnati, Ohio

[73] Assignee: The Procter & Gamble Company, Cincinnati, Ohio

[21] Appl. No.: 223,541

[22] Filed: Jan. 8, 1981

Related U.S. Application Data

[63] Continuation-in-part of Ser. No. 163,031, Jun. 26, 1980, abandoned.

[51] Int. Cl.[3] ..... C11D 1/12

[52] U.S. Cl. ..... 252/551; 252/532; 252/DIG. 14; 252/174.22

[58] Field of Search ..... 252/551, 532, DIG. 14, 252/174.22

[56] References Cited

U.S. PATENT DOCUMENTS

| | | | |
|---|---|---|---|
| 2,941,950 | 6/1960 | Korpi et al. | 252/551 |
| 3,413,331 | 11/1968 | Belser et al. | 260/458 |
| 3,468,805 | 9/1969 | Grifo et al. | 252/551 |
| 3,755,407 | 8/1973 | Wilkes | 260/451 |
| 3,775,349 | 11/1973 | Tuvell et al. | 252/547 |
| 3,812,042 | 5/1974 | Verdier | 252/552 X |
| 3,928,249 | 12/1975 | Nunziata et al. | 252/DIG. 14 X |
| 4,024,078 | 5/1977 | Gilbert et al. | 252/551 |
| 4,079,020 | 3/1978 | Mills et al. | 252/547 |
| 4,092,272 | 5/1978 | Nishimura et al. | 252/545 |

FOREIGN PATENT DOCUMENTS 52-152405 6/1976 Japan .

*Primary Examiner*—Mayer Weinblatt

*Attorney, Agent, or Firm*—Robert B. Aylor; Richard C. Witte; Thomas H. O'Flaherty

[57] ABSTRACT

Aqueous liquid dishwashing detergent compositions are prepared containing from about 10% to about 50% of a specific optimized anionic alkyl polyethoxylate sulfate surfactant which is at least partly in magnesium form, from about 1% to about 20% of a suds stabilizer, and from about 20% to about 88% water.

9 Claims, No Drawings

LIQUID DETERGENT COMPOSITION CONTAINING ALKYL SULFATE AND ALKYL ETHOXYLATED SULFATE

CROSS REFERENCE TO RELATED APPLICATIONS

This is a continuation-in-part of my copending application, Ser. No. 163,031, filed June 26, 1980 for Liquid Detergent Composition, now abandoned.

TECHNICAL FIELD AND BACKGROUND ART

The invention relates to aqueous high sudsing liquid detergent compositions containing specified amounts and types of surfactants especially useful in the washing of tableware, kitchenware and other hard surfaces.

The compositions of this invention provide more effective detergency for the same amount of surfactant utilizing alkyl sulfates and alkyl ethoxylate sulfates.

The performance of a detergent composition for cleaning glasses, dishes, and other articles is normally evaluated by the consumer in terms of sudsing. The liquid dishwashing detergent compositions presently on the market are designed to remove oily/greasy soils from glasses, dishes, and other tableware and kitchen utensils while maintaining an acceptable layer of suds.

SUMMARY OF THE INVENTION

The present invention comprises a liquid detergent composition containing by weight:

(a) from about 10% to about 50% of an anionic surfactant which has the general formula $RO(C_2H_4O)_X$-$SO_3M$ wherein R is an alkyl group containing from about 10 to about 16 carbon atoms, M is selected from the group consisting of sodium, potassium, ammonium, monoethanol ammonium, diethanol ammonium, triethanol ammonium, calcium and magnesium cations and mixtures thereof, and the ethoxylate distribution is such that, on a molar basis the compounds wherein X is 0 are from about 54% to about 60%, wherein X is 1 are from about 15% to about 20%, wherein X is 2 are from about 10% to about 13%, and wherein X is 3 are from about 6% to about 7% of the total, and there is sufficient magnesium to at least neutralize 50% of the anionic surfactant wherein x is 0;

(b) from 1% to about 20% of a suds stabilizer;

(c) from about 0% to about 10% of a detergency builder selected from inorganic phosphates, polyphosphates, silicates, and carbonates, organic carboxylates, phosphonates and mixtures thereof; and (d) from about 20% to about 88% water.

DETAILED DESCRIPTION OF THE INVENTION

The liquid detergent compositions of the present invention contain three essential components:

(a) the anionic surfactant;

(b) a suds stabilizer; and (c) water.

Optional ingredients can be added to provide various performance and aesthetic characteristics.

ANIONIC SURFACTANT

The compositions of this invention contain from about 10% to about 50% by weight of the specific anionic surfactant. Preferred compositions contain from about 20% to about 35% of said anionic surfactant by weight.

The anionic detergents can be described as the water-soluble salts, particularly the alkali metal, alkaline earth metal, ammonium and amine salts, of organic sulfuric reaction products having in their molecular structure an alkyl radical containing from about 10 to about 16 carbon atoms and a sulfuric acid ester radical. Included in the term alkyl is the alkyl portion of acyl radicals. Examples of the anionic synthetic detergents which can be used to form the anionic surfactant component of the compositions of the present invention are the sodium, ammonium, potassium or magnesium alkyl sulfates obtained by sulfating the higher alcohols ($C_{10}$–$C_{16}$ carbon atoms) and the lower, e.g. monoethoxylates of said alcohol. Mixtures of alkyl sulfates and alcohol monoethoxy sulfate wherein the alcohol monoethoxy sulfate is from about 70% to about 95%, preferably from about 75% to about 90%, more preferably from about 80% to about 85% of the mixture, provide the desired distribution of surfactants. Preferably the alcohol ethoxylate is prepared by conventional base catalysis.

It is essential that at least 50% of the anionic surfactant which is unethoxylated be in the form of the magnesium salt. Preferably, essentially all of the unethoxylated surfactant (X is 0) is in the magnesium form.

It is also possible to have the entire anionic surfactant in mangesium form, but this is less desirable. Preferably no more than about 90% is in the magnesium form.

SUDS STABILIZER

The compositions of this invention can contain up to about 20%, preferably from about 1.5% to about 10%, more preferably from about 2% to about 8%, of a suds stabilizing "nonionic" surfactant or mixtures thereof.

Optional suds stabilizing nonionic surfactants operable in the instant compositions are of three basic types—the ethylene oxide condensates, the fatty acid amides, and the amine oxide semi-polar nonionics.

The ethylene oxide condensates are broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired balance between hydrophilic and hydrophobic elements.

Examples of such ethylene oxide condensates suitable as suds stabilizers include:

(1) The condensation products of aliphatic alcohols with ethylene oxide. The alkyl chain of the aliphatic alcohol can either be straight or branched and generally contains from about 10 to about 18, preferably from about 10 to about 14 carbon atoms for best performance as suds stabilizers, the ethylene oxide being present in amounts of from about 5 moles to about 30, preferably from about 5 to about 14 moles of ethylene oxide per mole of alcohol.

Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. An example of a commercially available nonionic surfactant of this type includes Neodol 23-6.5 marketed by the Shell Chemical Company.

(2) The ethylene oxide condensates of alkyl phenols. These compounds include the condensation products of alkyl phenols having an alkyl group containing from about 6 to about 15, preferably from about 6 to about 10, carbon atoms in either a straight chain or branched chain configuration, with ethylene oxide, the ethylene oxide being present in amounts equal to from about 5 to about 30, preferably from about 5 to about 14 moles of ethylene oxide per mole of alkyl phenol. The alkyl substituent in such compounds can be derived, for example, from polymerized propylene, diisobutylene, octene, or nonene. Examples of compounds of this type include nonyl phenol condensed with about 9.5 moles of ethylene oxide per mole of nonyl phenol, and octyl phenol condensed with about 12 moles of ethylene oxide per mole of phenol. Commercially available nonionic surfactants of this type include Igepal CO-610 marketed by the GAF Corporation; and Triton X-45, X-114, X-100 and X-102, all marketed by the Rohm and Haas Company.

Examples of the amide type of nonionic surface active agent include the ammonia, monoethanol and diethanol amides of fatty acids having an acyl moiety of from about 8 to about 18 carbon atoms and represented by the general formula $$R_1\text{—}CO\text{—}N(H)_{m-1}(R_2OH)_{3-m}$$

wherein $R_1$ is a saturated or unsaturated, aliphatic hydrocarbon radical having from 7 to 21, preferably from 11 to 17 carbon atoms; $R_2$ represents a methylene or ethylene group; and m is 1, 2, or 3, preferably 1. Specific examples of said amides are mono-ethanol coconut fatty acids amide and diethanol dodecyl fatty acid amide. These acyl moieties may be derived from naturally occurring glycerides, e.g., coconut oil, palm oil, soybean oil and tallow, but can be derived synthetically, e.g., by the oxidation of petroleum, or by hydrogenation of carbon monoxide by the Fischer-Tropsch process. The monoethanol amides and diethanolamides of $C_{12-14}$ fatty acids are preferred.

Amine oxide semi-polar nonionic surface active agents comprise compounds and mixtures of compounds having the formula:

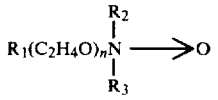

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl and n is from 0 to about 10. Particularly preferred are amine oxides of the formula:

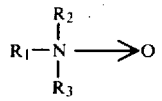

wherein $R_1$ is a $C_{10-14}$ alkyl and $R_2$ and $R_3$ are methyl or ethyl. The amine oxides are the most preferred suds stabilizing nonionic surfactants.

The preferred sudsing characteristics of the compositions of the invention are those which will provide the user of the product with an indication of cleaning potential in a dishwashing solution. Soils encountered in dishwashing act as suds depressants and the presence or absence of suds from the surface of a dishwashing solution is a convenient guide to product usage. Mixtures of anionic surfactants and suds stabilizing nonionic surfactants, especially amides and amine oxide nonionic surfactants, are preferably utilized in the compositions of the invention because of their high sudsing characteristics, their suds stability in the presence of food soils, and their ability to indicate accurately an adequate level of product usage in the presence of soil.

DRAINAGE PROMOTING ETHOXYLATED NONIONIC SURFACTANT

Optionally these compositions can contain the condensation product of various alcohols, alkyl phenols, or polyol fatty acid mono esters with ethylene oxide in which the carbon atom content of the alcohol, phenol or partial polyol ester is elevated and the degree of ethoxylation is high relative to ethoxylated nonionic surfactants typically incorporated in liquid dishwashing detergent compositions. These materials are described in detail in the copending application of John Benson Welch, Ser. No. 118,705, filed Feb. 5, 1980, for Liquid Detergent Compositions. More specifically, the compositions of the present invention can contain from about 2% to about 20%, preferably from about 3% to about 12%, and most preferably from about 4% to about 8%, of drainage promoting surfactants of the following classes of materials:

(a) an ethoxylated aliphatic alcohol of the formula $$R(OC_2H_4)_nOH$$

wherein R is an aliphatic hydrocarbyl radical containing from about 14 to about 30 carbon atoms, wherein n is from about 16 to about 100;

(b) an ethoxylated alkyl phenol of the formula $$R(OC_2H_4)_nOH$$

wherein R is an alkyl phenyl radical containing a total of from about 14 to about 30 carbon atoms and at least one alkyl group containing at least about 8 carbon atoms wherein n is from about 16 to about 100;

(c) the condensation product of mono $C_{16-22}$ fatty acid esters of polyglycols with from about 13 to about 100 moles of ethylene oxide per mole of partial ester;

(d) the condensation product of cholesterol and from about 13 to about 100 moles of ethylene oxide;

(e) a material which is a condensate of ethylene oxide, propylene oxide and a compound containing hydroxy or amine groups onto which the alkylene oxides can be polymerized, said polymer having a molecular weight of from about 500 to about 15,000, an ethylene oxide content of from about 30% to about 70% by weight and a propylene oxide content of from about 30% to about 70% by weight; and (f) mixtures thereof.

In a preferred embodiment of (a) the aliphatic alcohol contains from about 16 to about 22 carbon atoms and is ethoxylated to an average degree of from about 18 to about 50 moles of ethylene oxide per mole of alcohol.

In a preferred embodiment of (b) the alkyl phenol is ethoxylated to an average degree of from about 20 moles to about 60 moles of ethylene oxide per mole of alkyl phenol.

Other alkylene oxides, particularly propylene oxide, may be substituted for a part of the ethylene oxide in (a), (b), (c) or (d). In this event, the greater hydrophobicity of propylene oxide relative to ethylene oxide acts to reduce the hydrophobicity required from the alcohol, alkyl phenol or polyglycol partial ester. The optimum carbon atom content of the alcohol, alkyl phenol or partial ester is thereby reduced somewhat.

In preferred embodiments of (e) molecular weight will be in the range of from about 600 to about 5000 and the ethylene oxide content will be from about 40% to about 60% by weight.

Preferred embodiments of (e) include materials corresponding to the formula:

$$Y(C_3H_6O)_n(C_2H_4O)_mH$$

wherein Y is the residue of organic compound having from about 1 to 16 carbon atoms and one reactive hydrogen atom, n has an average value of at least about 6.4, as determined by hydroxyl number and m has a value such that the oxyethylene portion constitutes from about 30 to about 70 weight percent of the molecule; the conjugated polyoxyalkylene compounds described in U.S. Pat. No. 2,674,619, incorporated herein by reference, having the formula:

$$Y[(C_3H_6O)_n(C_2H_4O)_mH]_x$$

wherein Y is the residue of an organic compound having from about 2 to 6 carbon atoms and containing x reactive hydrogen atoms in which x has a value of at least about 2, n has a value such that the molecular weight of the polyoxypropylene hydrophobic base is at least about 900 and m has a value such that the oxyethylene content of the molecule is from about 30 to 70 weight percent. Compounds falling within the scope of the definition for Y include, for example, ethylene glycol, propylene glycol, glycerine, pentaerythritol, trimethylolpropane, ethylenediamine and the like. The oxypropylene chains optionally, but advatageously, contain small amounts of ethylene oxide and the oxyethylene chains also optionally, but advantageously, contain small amounts of propylene oxide.

Additional conjugated polyoxyalkylene surface-active agents which can be used in the compositions of this invention correspond to the formula:

$$P[(C_3H_6O)_n(C_2H_4O)_mH]_x$$

wherein P is the residue of an organic compound having from about 8 to 18 carbon atoms and containing x reactive hydrogen atoms in which x has a value of 1 or 2, n is at least 1, and m has a value such that the oxyethylene content of the molecule is from about 30 to 70 weight percent and the formula:

$$P[(C_2H_4O)_n(C_3H_6O)_mH]_x$$

wherein P is the residue of an organic compound having from about 8 to 18 carbon atoms and containing x reactive hydrogen atoms in which x has a value of 1 or 2, n is at least 1, and m has a value such that the oxypropylene content of the molecule is from about 30 to 70 weight percent. In either case the oxypropylene chains may contain optionally, but advantageously, small amounts of ethylene oxide and the oxyethylene chains may contain also optionally, but advantageously, small amounts of propylene oxide.

In preferred embodiments of the invention, the ratio of anionic surfactants to total nonionic surfactants in the composition will be in a molar ratio of from about 11:1 to about 1:1, more preferably from about 8:1 to about 3:1. From the standpoint of sudsing, the suds stabilizing nonionic surfactants are generally preferred, but the essential relatively highly ethoxylated drainage promoting nonionic surfactants of the invention can contribute to sudsing performance and are included in the calculation of ratios of anionic to nonionic surfactant.

WATER

The compositions of this invention contain from about 20% to about 88%, preferably from about 40% to about 70%, water.

ADDITIONAL OPTIONAL INGREDIENTS

The compositions of this invention can contain up to about 10%, by weight of detergency builders either of the organic or inorganic type. Examples of water-soluble inorganic builders which can be used, alone or in admixture with themselves and organic alkaline sequestrant builder salts, are alkali metal carbonates, phosphates polyphosphates, and silicates. Specific examples of such salts are sodium tripolyphosphate, sodium carbonate, potassium carbonate, sodium pyrophosphate, potassium pyrophosphate, potassium tripolyphosphate, and sodium hexametaphosphate. Examples of organic builder salts which can be used alone, or in admixture with each other or with the preceding inorganic alkaline builder salts, are alkali metal polycarboxylates, e.g., water-soluble citrates such as sodium and potassium citrate, sodium and potassium tartrate, sodium and potassium ethylenediaminetetraacetate, sodium and potassium N-(2-hydroxyethyl)-ethylene diamine triacetates, sodium and potassium nitrilo triacetates (NTA) and sodium and potassium N-(2-hydroxyethyl)-nitrilo diacetates. Other organic detergency builders such as water-soluble phosphonates can find use in the compositions of the invention. In general, however, detergency builders have limited value in dishwashing detergent compositions and use at levels above about 10% can restrict formulation flexibility in liquid compositions because of solubility and phase stability considerations.

Alcohols, such as ethyl alcohol, and hydrotropes, such as sodium and potassium toluene sulfonate, sodium and potassium xylene sulfonate, trisodium sulfosuccinate and related compounds (as disclosed in U.S. Pat. No. 3,915,903, incorporated herein by reference) and urea, can be utilized in the interests of achieving a desired product phase stability and viscosity. Ethyl alcohol at a level of from about 3% to about 15% and potassium or sodium toluene, xylene or cumene sulfonate at a level of from about 1% to about 6% are particularly useful in the compositions of the invention.

The detergent compositions of this invention can contain, if desired, any of the usual adjuvants, diluents and additives, for example, perfumes, enzymes, dyes, antitarnishing agents, antimicrobial agents, and the like, without detracting from the advantageous properties of the compositions. Alkalinity sources and pH buffering agents such as monoethanolamine, triethanolamine and alkali metal hydroxides can also be utilized.

The following examples are given to illustrate the compositions of the invention. All percentages are by weight unless otherwise indicated.

EXAMPLE I

The following liquid detergent compositions were prepared.

| | OPTIMIZED PRODUCT | UNOPTIMIZED PRODUCTS | | | |
|---|---|---|---|---|---|
| Composition (%) | A | B | C | D | E |
| Anionic Surfactant ($NH_4^+$ form)* | 24.3 | 25.2 | 24.1 | 23.5 | 26.0 |
| Coconut alkyldimethyl amine oxide | 4.0 | 4.0 | 4.0 | 4.0 | 4.0 |
| Ammonium xylene sulfonate | 2.5 | 2.5 | 2.5 | 2.5 | 2.5 |
| Ethanol | 6.25 | 6.25 | 6.25 | 6.25 | 6.25 |
| KCl | 0.75 | 0.75 | 0.75 | 0.75 | 0.75 |
| Citric Acid | 0.10 | 0.10 | 0.10 | 0.10 | 0.10 |
| Water & Miscellaneous | | Balance | | | |

*Equal number of moles for all formulations

| Ethoxylate Distribution (Wt. %/Molar %) | A | B | C | D | E |
|---|---|---|---|---|---|
| $E_0$ | 45.2/55.1 | 45.1/51.8 | 69.2/64.5 | 76.9/71.6 | 52.3/66.8 |
| $E_1$ | 19.7/19.6 | 21.4/21.2 | 13.5/14.6 | 10.2/11.0 | 6.3/6.4 |
| $E_2$ | 14.8/12.4 | 15.6/13.6 | 8.7/9.4 | 6.5/8.0 | 7.6/6.6 |
| $E_3$ | 8.4/6.1 | 9.7/7.5 | 4.8/5.9 | 3.6/4.9 | 7.8/5.9 |
| $E_4$ | 4.8/3.1 | 4.7/3.6 | 2.3/3.2 | 1.7/2.6 | 7.1/4.7 |
| $E_5$ | 2.8/1.6 | 2.2/1.5 | 1.0/1.5 | 0.7/1.2 | 5.9/3.5 |
| $E_6$ | 1.9/1.0 | 1.0/0.6 | 0.4/0.7 | 0.3/0.5 | 4.6/2.4 |
| $E_7$ | 1.4/0.7 | 0.3/0.2 | 0.1/0.2 | 0.1/0.2 | 3.5/1.7 |
| $E_8$ | 1.0/0.4 | —/— | —/— | —/— | 2.5/1.1 |
| $E_9$ | —/— | —/— | —/— | —/— | 1.6/0.7 |
| $E_{10}$ | —/— | —/— | —/— | —/— | 0.8/0.2 |
| | 100/100 | 100/100 | 100/100 | 100/100 | 100/100 |

| | OPTIMIZED PRODUCT | UNOPTIMIZED PRODUCTS | | | |
|---|---|---|---|---|---|
| Composition % | F | G | H | I | J |
| Anionic Surfactant (80% $Mg^{++}$ form, 20% $NH_4^+$ form)* | 28.1 | 28.8 | 28.1 | 27.9 | 30.0 |
| Coconut alkyl dimethyl amine oxide | 3.0 | 3.0 | 3.0 | 3.0 | 3.0 |
| Ammonium xylene sulfonate | 3.0 | 3.0 | 3.0 | 3.0 | 3.0 |
| Ethyl alcohol | 5.5 | 5.5 | 5.5 | 5.5 | 5.5 |
| Water & Miscellaneous | | Balance | | | |

*Equal number of moles for all formulations

| Ethoxylate Distribution (Wt. %/Molar %) | F | G | H | I | J |
|---|---|---|---|---|---|
| $E_0$ | 45.2/55.1 | 45.1/51.8 | 62.8/68.0 | 70.3/75.9 | 52.3/66.8 |
| $E_1$ | 19.7/19.6 | 21.4/21.2 | 13.1/14.1 | 11.3/10.5 | 6.3/6.4 |
| $E_2$ | 14.8/12.4 | 15.6/13.6 | 11.0/9.0 | 8.3/6.8 | 7.6/6.6 |
| $E_3$ | 8.4/6.1 | 9.7/7.5 | 6.9/5.0 | 5.2/3.8 | 7.8/5.9 |
| $E_4$ | 4.8/3.1 | 4.7/3.6 | 3.6/2.4 | 2.8/1.8 | 7.1/4.7 |
| $E_5$ | 2.8/1.6 | 2.2/1.5 | 1.7/1.0 | 1.3/0.8 | 5.9/3.5 |
| $E_6$ | 1.9/1.0 | 1.0/0.6 | 0.7/0.4 | 0.6/0.3 | 4.6/2.4 |
| $E_7$ | 1.4/0.7 | 0.3/0.2 | 0.2/0.1 | 0.2/0.1 | 3.5/1.7 |
| $E_8$ | 1.0/0.4 | —/— | —/— | —/— | 2.5/1.1 |
| $E_9$ | —/— | —/— | —/— | —/— | 1.6/0.7 |
| $E_{10}$ | —/— | —/— | —/— | —/— | 0.8/0.2 |
| | 100/100 | 100/100 | 100/100 | 100/100 | 100/100 |

SUDSING

Suds were generated by agitation in dishpans containing 2 gallons of water having the indicated temperatures and hardnesses, using Compositions A–J at a 0.2% product concentration. Dinner plates were washed with the introduction of 4.0 ml of a triglyceride-containing soil on each plate. Suds height is measured after washing sets of five plates. This procedure is repeated five times for a total of 25 plates. The suds height after washing each set is expressed in terms of percent of original suds height and an average of the five values is reported as suds during washing (SDW). The number of plates washed when suds disappear from the surface of the dishwashing solution is recorded as "mileage."

The following sudsing results were obtained:

Sudsing Performance

| | Test | Hardness | Soil | Initial Temp. |
|---|---|---|---|---|
| Mileage (Plates) | 1 | 7 gpg | 100% fat | 115° F. |
| | 2 | 14 gpg | mixed fat protein, carbohydrate and acid | 115° F. |
| | 3 | 14 gpg | mixed fat, protein, carbohydrate and acid | 100° F. |

| Test | A | B | C | D | E | $LSD_{05}$ |
|---|---|---|---|---|---|---|
| 1 | Base | −1.5S | −1.5S | −0.5 | −0.5 | 1.4 |
| 2 | Base | −1.5S | −1.5S | −2.5S | −1.5S | 1.4 |
| 3 | Base | −2.5S | −1.0 | −3.0S | −1.0 | 2.3 |

| | Test | Hardness | Soil | Initial Temp. |
|---|---|---|---|---|
| SDW(Area) | 4 | 14 gpg | 100% fat | 115° F. |
| | 5 | 14 gpg | 100% fat | 115° F. |
| Mileage (Plates) | 6 | 14 gpg | mixed fat, protein, carbohydrates and acid | 115° F. |

| Test | F | G | H | I | J | $LSD_{10}$ |
|---|---|---|---|---|---|---|
| 4 | Base | 0.0 | −3.1S | −2.1S | −0.8 | 1.0 |
| 5 | Base | −2.4S | −1.6 | −2.0S | 0.0 | 2.0 |
| 6 | Base | — | −1.6S | — | −1.6S | 0.7 |

S = statistically different at 10% risk

When A and F were tested in a real life situation the totally unexpected result was that F was preferred by consumers whereas A was found to be deficient despite its technical superiority under laboratory conditions.

What is claimed is:

1. A liquid detergent composition consisting essentially of:

(a) from about 10% to about 50% by weight of an anionic surfactant which has the general formula $RO(C_2H_4O)_xSO_3M$ wherein R is an alkyl group containing from about 10 to about 16 carbon atoms, M is selected from the group consisting of sodium, potassium, ammonium, monoethanolammonium, diethanolammonium, triethanolammonium, calcium and magnesium cations and mixtures thereof, and the ethoxylate distribution is such that, on a molar basis the compounds wherein x is 0 are from about 54% to about 60%, wherein x is 1 are from about 5% to about 20%, wherein x is 2 are from about 10% to about 13%, and wherein x is 3 are from about 6% to about 7% of the anionic surfactant, and there is sufficient magnesium to at least neutralize 50% of the anionic surfactant wherein x is 0;

(b) from about 1% to about 20% by weight of a suds stabilizing nonionic surfactant selected from the group consisting of the condensation products of aliphatic alcohols containing from about 10 to about 18 carbon atoms with from about 5 moles to about 30 moles of ethylene oxide, the condensation products of alkyl phenols having an alkyl group containing from about 6 to about 15 carbon atoms with from about 5 to about 30 moles of ethylene oxide per mole of alkyl phenol, fatty acid amides containing an acyl moiety of from about 8 to about 18 carbon atoms, amine oxide semi-polar nonionic surface active agents, and mixtures thereof;

(c) from 0% to about 10% of a detergency builder selected from the group consisting of sodium tripolyphosphate, sodium carbonate, potassium carbonate, sodium pyrophosphate, potassium pyrophosphate, potassium tripolyphosphate, sodium hexametaphosphate, sodium citrate, potassium citrate, sodium tartrate, potassium tartrate, sodium ethylenediamine tetraacetate, potassium ethylenediamine tetraacetate, sodium N-(2-hydroxyethyl)-ethylenediamine triacetate, potassium N-(2-hydroxyethyl)-ethylenediamine triacetate, sodium nitrilotriacetate, potassium nitrilotriacetate, sodium N-(2-hydroxyethyl)-nitrilodiacetate, potassium N-(2-hydroxyethyl)-nitrilodiacetate, and mixtures thereof; and (d) from about 20% to about 88% water.

2. The composition of claim 1 comprising from about 1.5% to about 12% of the suds stabilizer which is a nonionic surfactant selected from the group consisting of a $C_{10-14}$ alkyl amine oxide, $C_{8-18}$ amides, ethylene oxide condensates of $C_{10-14}$ alcohols or $C_{6-10}$ mono alkyl phenols with from about 5 moles to about 14 moles of ethylene oxide per mole of alcohol or alkyl phenol, and mixtures thereof.

3. The composition of claim 2 wherein the molar ratio of anionic surfactant to suds stabilizer is from about 11:1 to about 1:1.

4. The composition of claim 3 comprising a suds stabilizing nonionic surfactant selected from the group consisting of dimethyl $C_{12-14}$ alkyldimethylamine oxides, $C_{10-16}$ acyl ethanolamides and mixtures thereof.

5. The composition of claim 4 wherein the anionic surfactant comprises from about 20% to about 35% by weight of said composition.

6. The composition of claim 1 or 2 wherein the suds stabilizer comprises an ethoxylated aliphatic alcohol.

7. The composition of claim 1 wherein the suds stabilizer is an amine oxide semi-polar nonionic surface active agent having the formula:

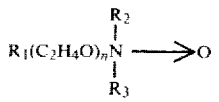

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl and n is from 0 to about 10.

8. The composition of claim 1 additionally containing from about 2% to about 20% by weight of a drainage promoting nonionic surfactant selected from the group consisting of:

(a) an ethoxylated aliphatic alcohol of the formula $R(OC_2H_4)_nOH$ wherein R is an alkyl radical containing from about 10 to about 30 carbon atoms, wherein n is from about 16 to about 100;

(b) an ethoxylated alkyl phenol of the formula $R(OC_2H_4)_nOH$ wherein R is an alkyl phenyl radical containing a total of from about 14 to about 30 carbon atoms and at least one alkyl group containing at least about 8 carbon atoms, wherein n is from about 16 to about 100;

(c) the condensation product of mono $C_{16-22}$ fatty acid esters of polyglycols with from about 13 to about 100 moles of ethylene oxide per mole of the monoester;

(d) the condensation product of cholesterol and from about 13 to about 100 moles of ethylene oxide;

(e) a material which is a condensate of ethylene oxide, propylene oxide and a compound containing hydroxy or amine groups onto which alkylene oxides can be polymerized, said polymer having a molecular weight of from about 500 to about 15,000, an ethylene oxide content of from about 30% to about 70% by weight and a propylene oxide content of from about 30% to about 70% by weight; and (f) mixtures thereof.

9. The composition of claim 8 wherein the drainage promoting nonionic surfactant comprises an ethoxylated aliphatic alcohol of the formula $R(OC_2H_4)_nOH$ wherein R is an aliphatic hydrocarbyl radical containing from about 16 to about 30 carbon atoms and wherein n is from about 16 to about 50.

* * * * *